US005131548A

United States Patent [19]

Chi

[11] Patent Number: 5,131,548

[45] Date of Patent: Jul. 21, 1992

[54] SLACKLESS, RESILIENT DRAWBAR SYSTEM FOR A RAILWAY CAR

[75] Inventor: Edward Chi, Darien, Ill.

[73] Assignee: National Castings, Inc., Lisle, Ill.

[21] Appl. No.: 704,439

[22] Filed: May 23, 1991

[51] Int. Cl.[5] ..... B61G 9/06

[52] U.S. Cl. ..... 213/64; 213/67 R

[58] Field of Search ..... 213/62 R, 64, 69, 40 R, 213/7, 75 R, 61, 50, 67 R, 67 A; 105/3, 4.1; 267/138, 196

[56] References Cited

U.S. PATENT DOCUMENTS

| | | | |
|---|---|---|---|
| 2,452,015 | 10/1948 | Kinne et al. | 213/67 R |
| 2,880,888 | 4/1959 | Blattner | 213/64 |
| 3,716,146 | 2/1973 | Altherr | 213/64 X |
| 4,243,149 | 1/1981 | DePenti | 213/67 R X |
| 4,258,628 | 3/1981 | Altherr | 213/75 R X |
| 4,422,557 | 12/1983 | Altherr | 213/62 R |
| 4,456,133 | 6/1984 | Altherr et al. | 213/62 R |
| 4,531,648 | 7/1985 | Paton | 213/64 X |
| 4,545,394 | 10/1985 | Brodeur et al. | 105/3 |
| 4,549,666 | 10/1985 | Altherr et al. | 213/62 A |
| 4,555,033 | 11/1985 | Miller | 213/51 |
| 4,580,686 | 4/1986 | Elliott | 213/62 A |

FOREIGN PATENT DOCUMENTS

| | | | |
|---|---|---|---|
| 1258258 | 8/1989 | Canada | 213/61 |

OTHER PUBLICATIONS

"Innovative Engineering Concepts for Unit Train Service: The Slackless Drawbar Train . . . ", Heavy Haul Railway Conference, Sep. 1989.

*Primary Examiner*—Robert J. Oberleitner
*Assistant Examiner*—Kevin D. Rutherford
*Attorney, Agent, or Firm*—Milton S. Gerstein; Marvin N. Benn

[57] ABSTRACT

A slackless drawbar system for a railway car in which there is provided an elastomeric pad that absorbs forces during buffing conditions and helps to maintain the slackless nature of the system. The elastomeric pad absorbs forces during lateral and vertical angling and serves to maintain the slackless nature of the system during these conditions. Preloading of the resilient elastomeric pad is provided by means of an adjustable wedge element, which wedge element is adjustably positionable relative to the elastomeric pad by means of a screw shaft and nut, whereby the initial loading of the pad may be achieved to meet any required operating conditions and to accommodate wear and tear.

6 Claims, 6 Drawing Sheets

SLACKLESS, RESILIENT DRAWBAR SYSTEM FOR A RAILWAY CAR

BACKGROUND OF THE INVENTION

The present invention is directed to a slackless drawbar system for coupling railway cars. Slackless drawbar systems are well-known, examples of such being shown in the following U.S. Pat. No. 4,422,557 - Altherr; No. 4,456,133 Altherr et al; and No. 4,531,648 - Paton. While the drawbar systems of these patents perform satisfactorily, the drawbar system of the present invention offers greater performancecapabilities during buffing and pulling conditions, as well as during lateral and vertical angling. In addition, the drawbar system of the present invention provides an easily serviceable system, in order to cut down on repair and maintenance time required during servicing of the drawbar system.

SUMMARY OF THE INVENTION

It is the primary objective of the present invention to provide an improved slackless drawbar system for a railway car in which there is provided an elastomeric pad that absorbs forces during buffing conditions and helps to maintain the slackless nature of the system.

It is another objective of the invention to provide such an elastomeric pad that absorbs forces during lateral and vertical angling and serves to maintain the slackless nature of the system during these conditions.

It is still another objective of the present invention to preload the resilient elastomeric pad by means of an adjustable wedge element, which wedge element is adjustably positionable relative to the elastomeric pad by means of a screw shaft and nut, whereby the initial loading of the pad may be achieved to meet any required operating conditions.

It is yet another objective of the present invention to provide a vertical yoke pivot pin for rotatably mounting the butt end of the drawbar shank, whereby, during service and maintenance, relatively easy access is achieved to the pivot pin in order to disconnect and remove the parts of the system.

It still another objective of the present invention to provide a yoke which itself is provided with a front flange member that serves as a front stop that cooperates with the striker of the center sill.

BRIEF DESCRIPTION OF THE DRAWINGS

The invention will be more readily understood with reference to the accompanying drawing, wherein.

DETAILED DESCRIPTION OF THE INVENTION

Figure 1:
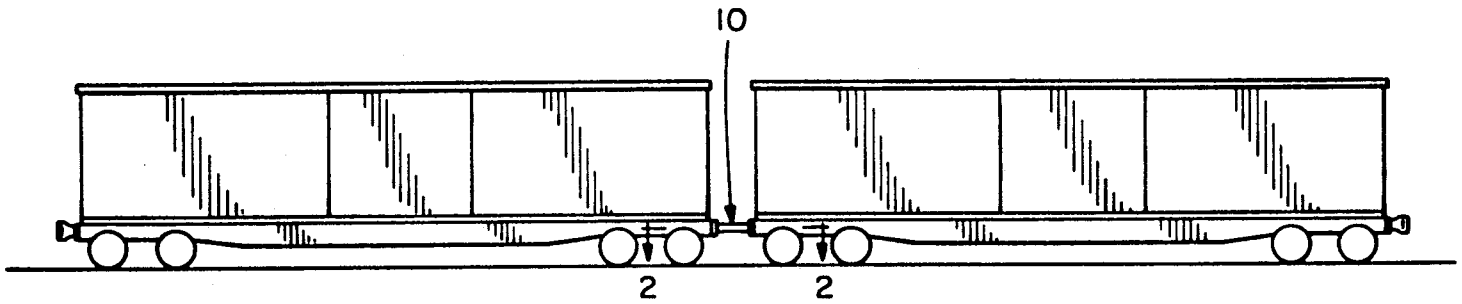
FIG. 1 is a side elevational view of two railway cars coupled together by the drawbar system of the present invention.
Figure 2:
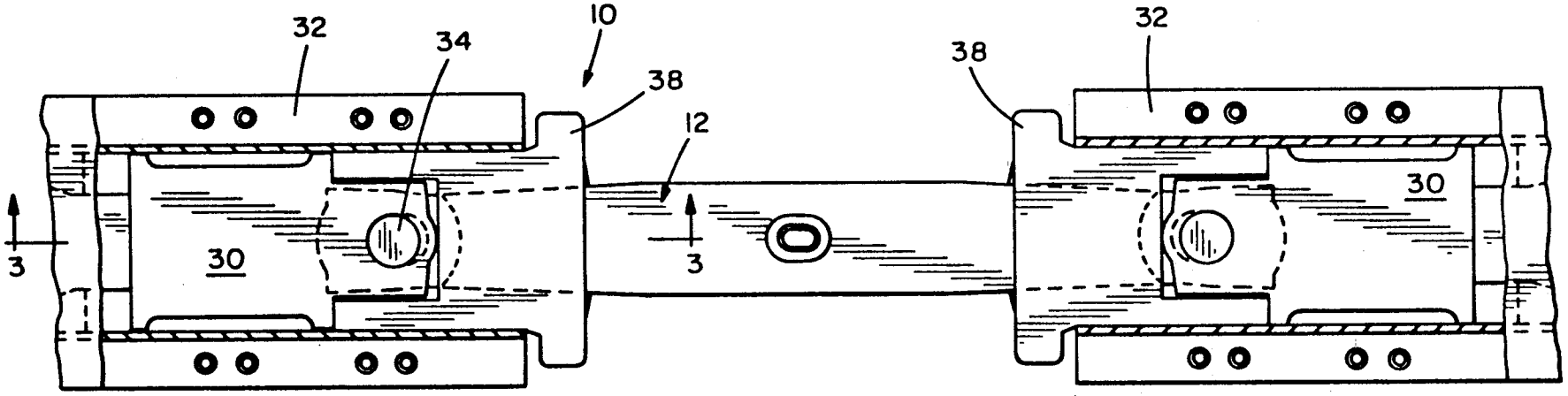
FIG. 2 is a cross-sectional view taken along line 2—2 of FIG. 1.

Referring now to the drawings in greater detail, the slackless, resilient drawbar system of the present invention is indicated generally by reference numeral 10, and includes a drawbar shank 12 which terminates in a convex-shaped butt-end 12'. The shank and the butt are symmetrical with respect to the central line of the shank (coupler line), and are based on the geometrical availability of the existing field E & F type strikers, or other type of strikers. The drawbar shank maximizes and optimizes the resistance to buckling and critical load in terms of impacting buff load per A.A.R. standards. The coupler length of the shank also is a function of the horizontal angle, vertical angle and 1/v ratio.

The butt 12' is received in a follower 14 defining a concave-shaped front surface-face 14' that mates with the shaped butt 12'. The other end of drawbar shank 12 is convex-s similarly structured and received in a follower of an adjacent, adjoining railway car. The follower 14, in the rear surface, defines a partially-open pocket 16 in which is mounted a first, front half of an elastomeric pad 18, which pad absorbs forces during buffing condition, and ensures a slackless drawbar system, as set forth below in greater detail. The pad 18 is made of rubber material, and is laminated with eight steel plates 19, between which is provided the rubber material, the rubber being adhesively, or otherwise, bonded to the faces of the steel plates. The main functions of this laminated resilient pad are:

A) For compensating the interference between the pin hole of drawbar and pin during vertical angling;

B) For eliminating the gap (slackness) between the follower and the shank of drawbar, pin and pin hole during the process of changing from buff to pull, or pull to buff, and the corresponding slackness which develops due to material wear.

C) For absorbing certain amount of buffing load, and for increasing element fatigue life. The main design criteria are the physical behavior of the laminated resilient pad is the non-linear relationship between the application load vs. travel distance, as defined as follows. The stiffness K of the pad is defined as:

K (preload)=amt of preload/travel distance

K (working)=amt of working load/travel distance, where the working area is 48 square inches or up, and the overall design thickness is 3.5 inches.

The rear half of the elastomeric pad 18 is received in another partially-open pocket 20' formed in the rear portion of a front wedge element 20. The two partially-open pockets 16 and 20' together form one larger, substantially closed pocket in which the elastomeric pad 18 is positioned, so that, as the larger pocket contracts due to the rearward movement of the shank butt 12', the elastomeric pad 18 will be compressed, which occurs during buffing conditions, when the shank 12 is moved rearwardly in the direction of the pad. Each of the follower 14 and the front wedge element 20 defines an annular, rectilinear-shaped, flange 22, 24, respectively, defining oppositely-juxtapositioned, cooperating limit-stop surfaces 22', 24'(see FIG. 4). These surfaces 22', 24' prevent the elastomeric pad 18 from being overly compressed during buffing. Thus, during the initial stages of buffing, all forces and shocks are absorbed by the elastomeric pad 18, with excessive buffing forces being taken up by the protective stops 22', 24', where they are transmitted directly to the car frame via the yoke. Guide pins 17 may also be provided in mutually-facing openings in the flanges 22, 24 to guide the movement of the two stop surfaces 22', 24' toward and away from each other. The length of the opening in the surface 20', which length is taken in the downward, vertical direction when viewing FIG. 4, is sufficient enough so as to allow leeway to accommodate all of the vertical positions of the vertically-adjustable front wedge member 20, as described below in greater detail.

The shank 12 is coupled to the yoke 30 of the railway car sill 32 and for articulated pivotal movement relative to the yoke in the lateral directions via a vertical pivot pin 34, which pin 34 passes through a vertical passage or opening 36 formed in the shank 12 adjacent the butt 12' of the drawbar. The pin 34 is a Y47 pin-A.A.R. standard. The yoke is a sub-housing for the pin, follower, laminated resilient pad, and wedges, and transfers the pulling and buffing loads to the front and rear stops. The yoke 30 will fit most existing E & F type, or other type, of strikers. The diameter of the opening 36 is larger than the diameter of the pin 34 in order to allow proper angling of the shank 12. During pulling conditions, the shank-end directly contacts the pin surface area whereby the yoke, and, therefore, the car frame are pulled therewith. According to the invention, the yoke 30 defines an enlarged, front, annular flange 36 that serves as the front stop that abuts against the striker plate 38 of the car center sill 32, whereby, during pulling conditions (as seen in FIG. 4), the yoke abuts the striker plate via the cooperating front stop surface 36' of the stop 36. During buffing conditions (as seen in FIG. 9), buffing forces are transmitted to the car frame via the yoke's buffing surface 37.

Figure 3:
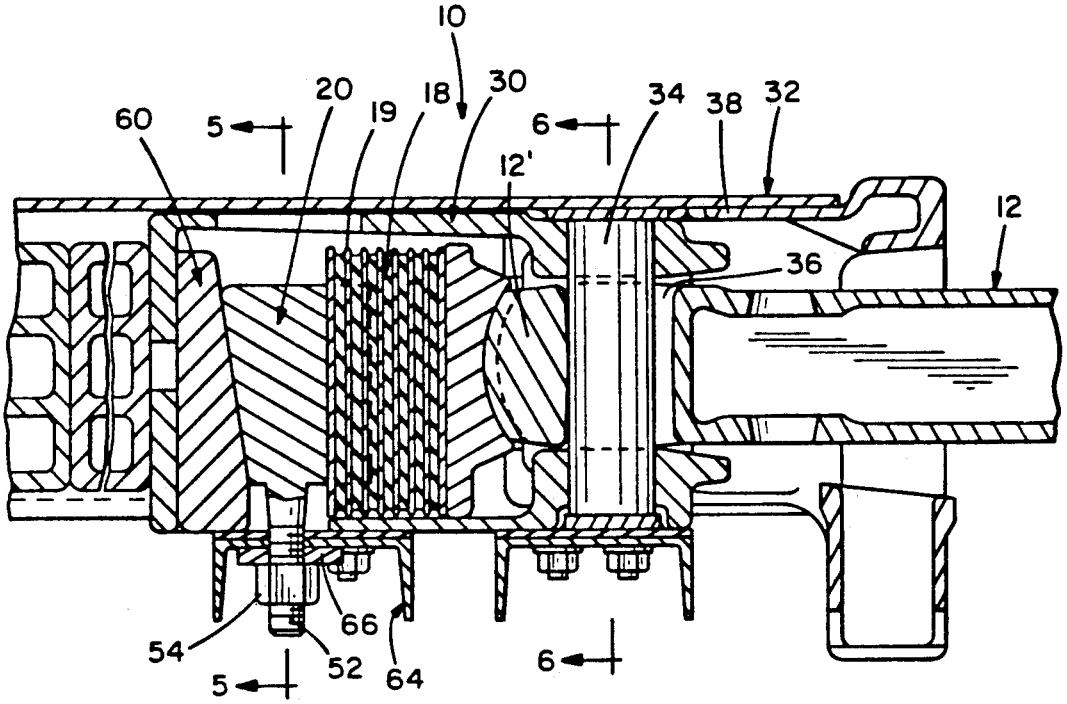
FIG. 3 is a cross-sectional view taken along line 3—3 of FIG. 2.
Figure 4:
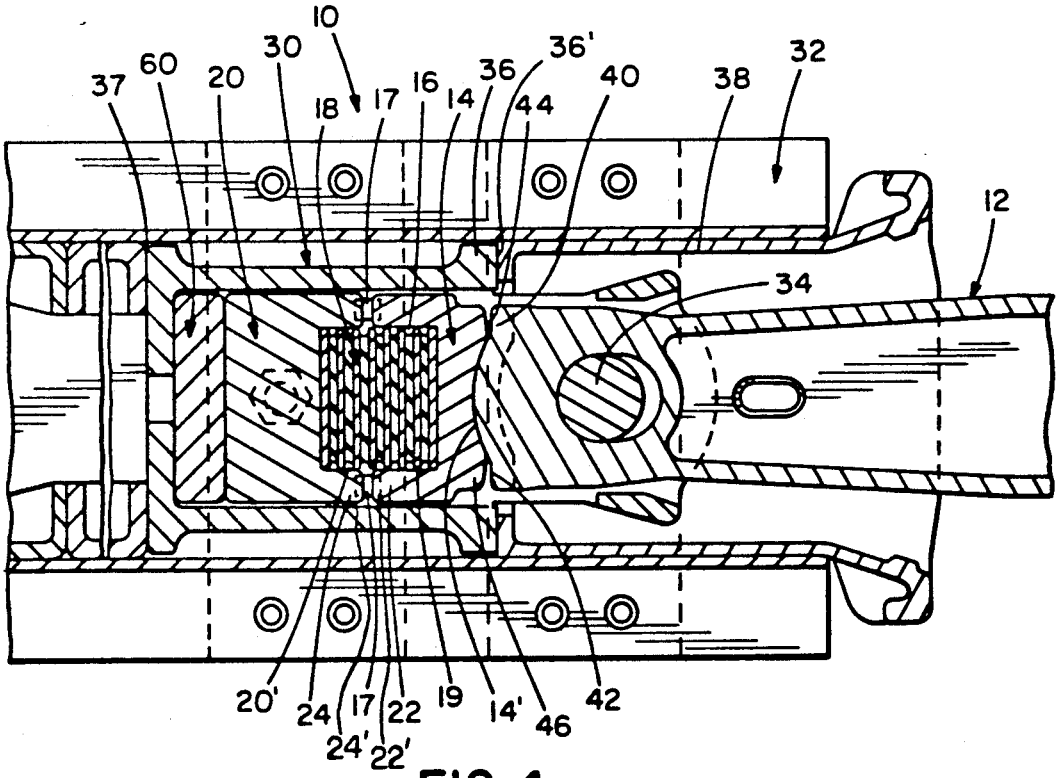
FIG. 4 is a top plan view, in cross section, of the slackless, resilient drawbar system of the invention.
Figure 9:
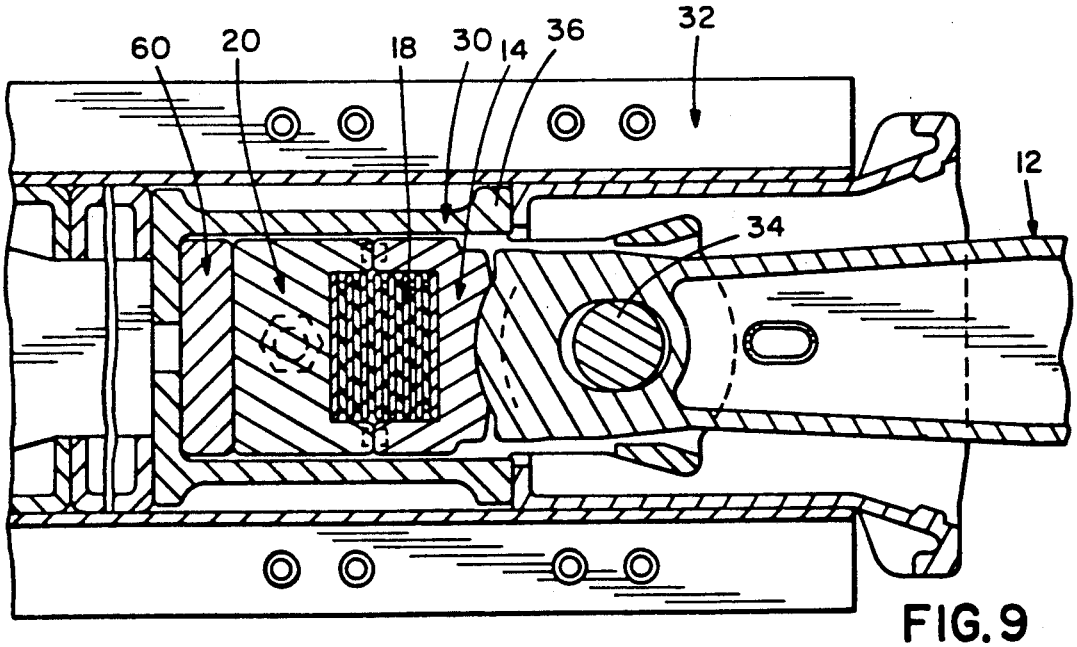
FIG. 9 is a top sectional view similar to FIG. 4 but showing the drawbar system of the invention in full buffing condition with the elastomeric pad being compressed to its allowable maximum.
Figure 10:
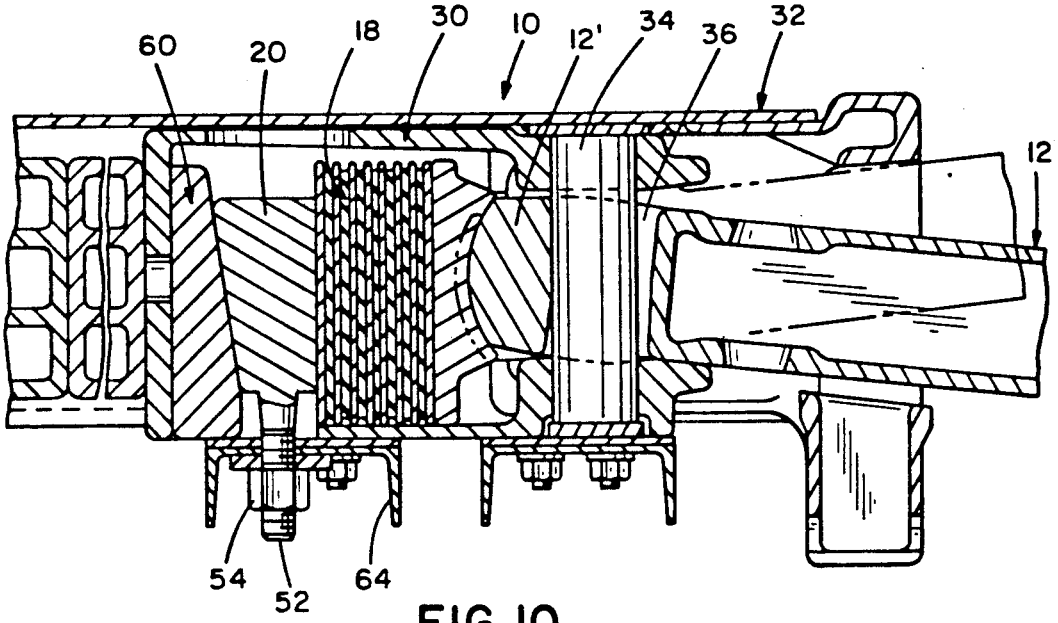
FIG. 10 is a side elevational view, in cross section, similar to FIG. 3, but showing the drawbar undergoing vertical angling.
Figure 11:
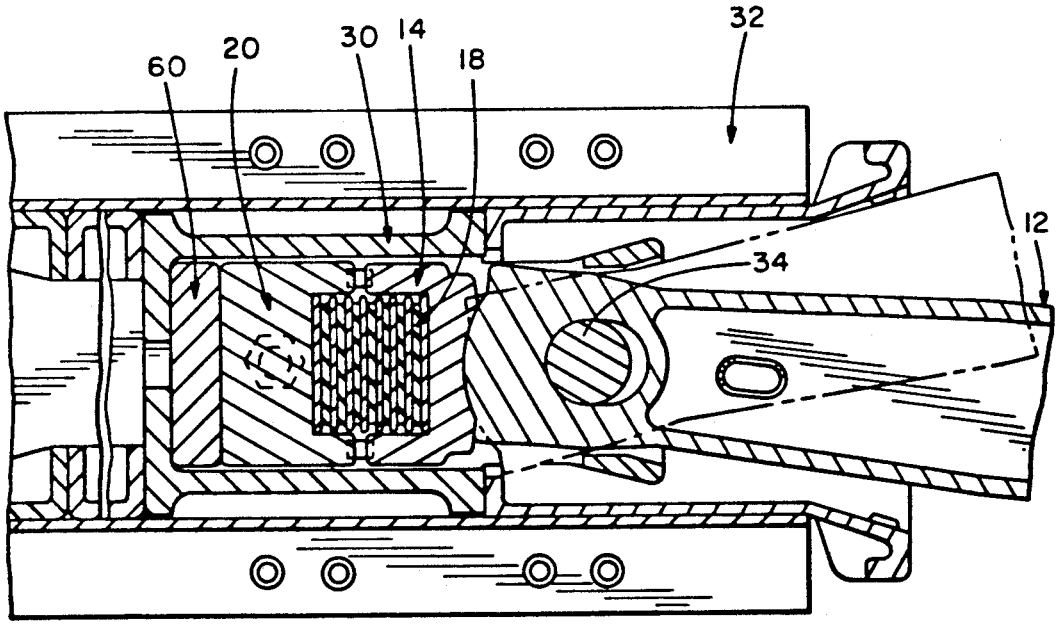
FIG. 11 is a top view, in cross section, similar to FIG. 4 but showing the drawbar undergoing lateral angling.
Figure 12:
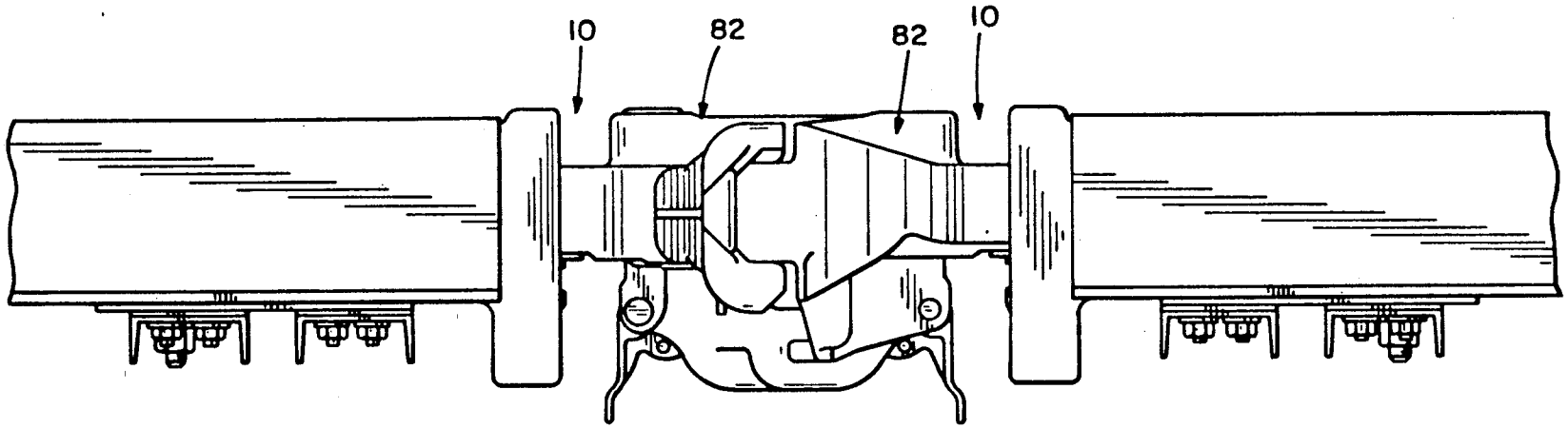
FIG. 12 is a side elevational view showing the drawbar system incorporated into a knuckle-coupler assembly.
Figure 13:
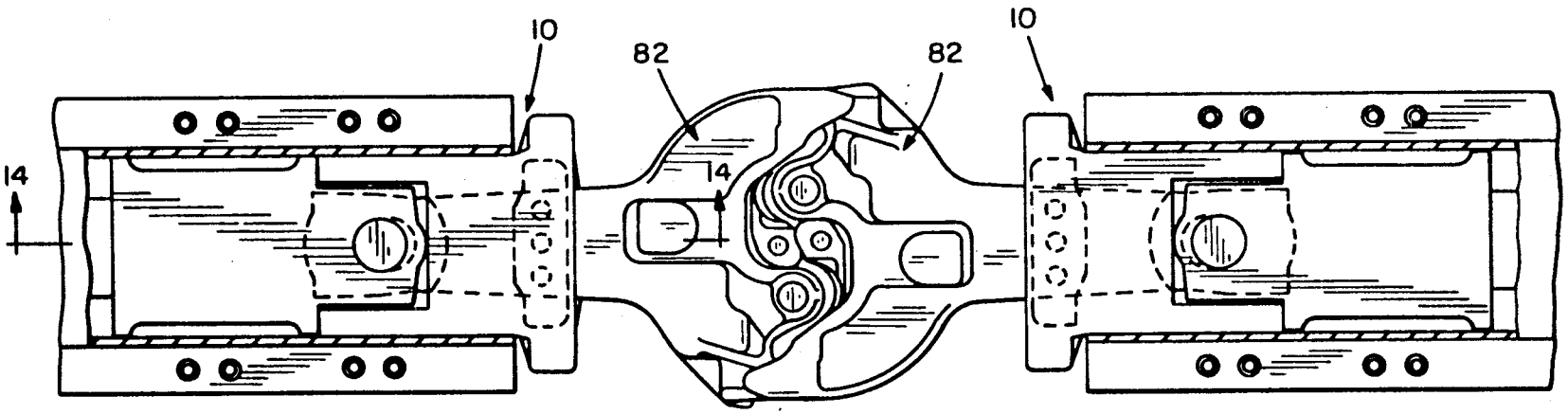
FIG. 13 is a top plan view thereof.
Figure 14:
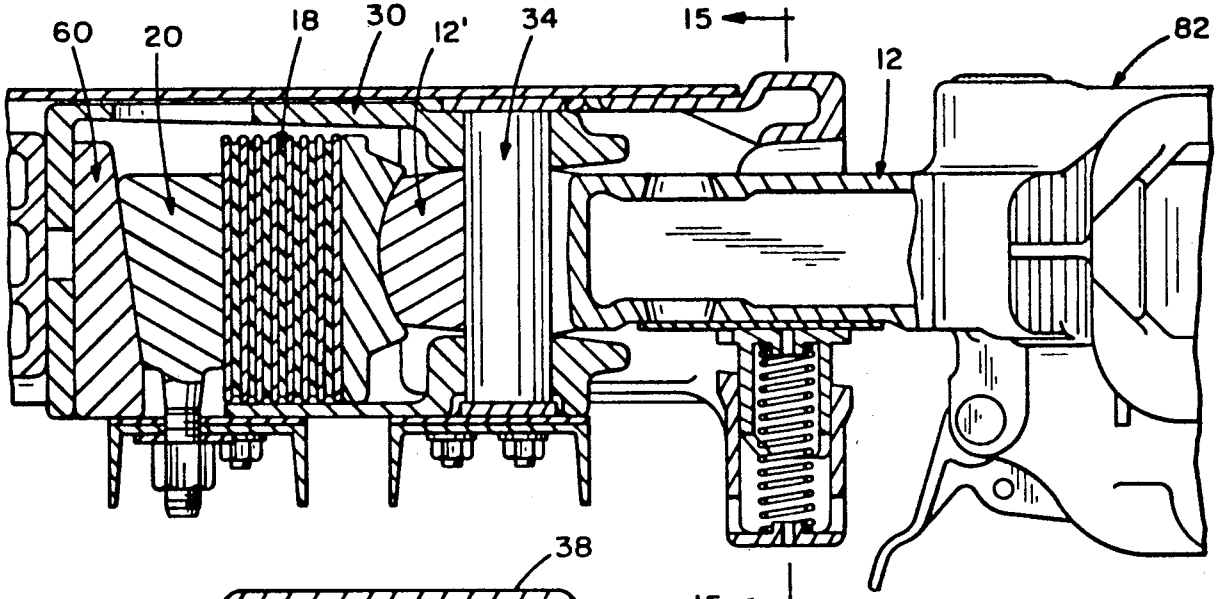
FIG. 14 is a cross-sectional view taken along line 14—14 of FIG. 13.
Figure 15:
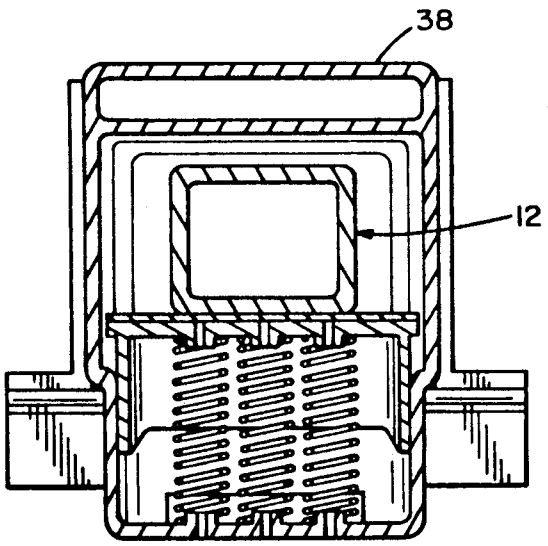
FIG. 15 is a cross-sectional view taken along line 15—15 of FIG. 11.

As shown in FIGS. 4, 9 and 11, the convex-shaped, or spherical-shaped, butt 12' also has a pair of diametrically-opposed flat surfaces 40, 42, which are used during lateral angling. Each flat surface, during non-angling conditions, is spaced from contact with the corresponding, oppositely-juxtapositioned, receding flat surfaces 44, 46, respectively, of the front surface of the follower 14. Upon lateral angling in one direction or the other, one or the other of the pair of flat surfaces 40, 42 is drawn closer to one of the follower-surfaces 44, 46. For angling past a predetermined amount, one of the flat surfaces 40, 42 actually abuts against one of the follower surfaces 44, 46, to thereby move the follower, and thereby compress the elastomeric pad 18, which pad, thereby, absorbs angling forces, and ensures a slackless coupling. The elastomeric pad 18 also absorbs vertical angling forces during vertical angling, as can be seen by comparing FIG. 3 with FIG. 10, in which FIG. 10 the shank is shown in a position assumed during vertical angling.

The wedge 20, operatively associated with the follower 14, is an adjustable front wedge member. The wedge angle is 8.0 degrees, and has a surface coefficient of friction: 0.50 to 0.78. The main functions of the front wedge are:

A) Applying a preload to the laminated resilient pad up to 60,000 lbs.

B) Transferring the buff load to the rear stop.

C) As a protecting device with the follower to prevent the pad material from going into the plastic range.

Figure 5:
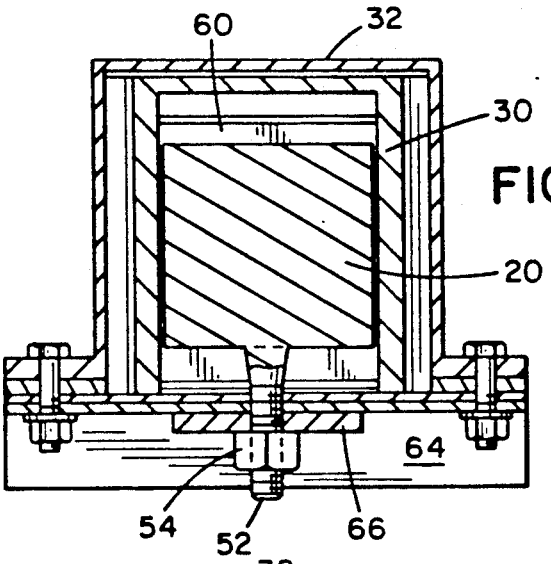
FIG. 5 is a cross-sectional view taken along line 5—5 of FIG. 3.
Figure 7:
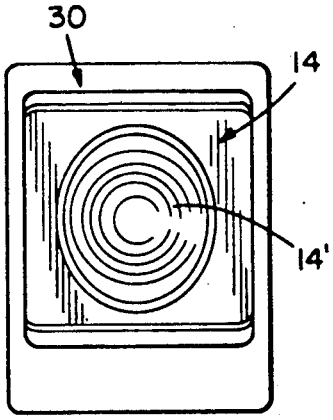
FIG. 7 is a front view of the follower.
Figure 6:
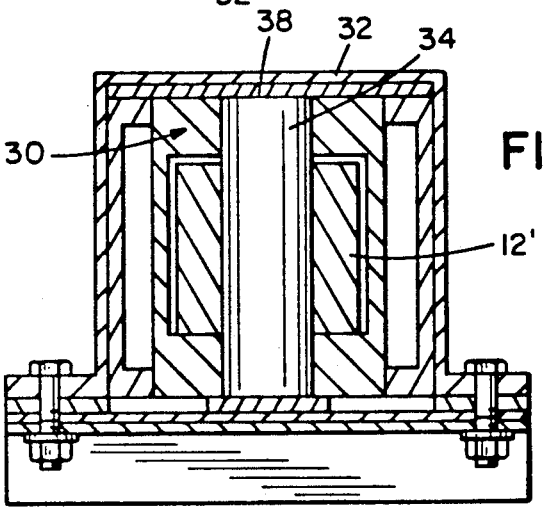
FIG. 6 is a cross-sectional view taken along line 6—6 of FIG. 3.
Figure 8:
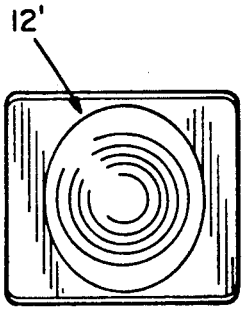
FIG. 8 is a rear view of the butt-end of the drawbar shank.

Like prior-art wedges, the wedge 20 is designed to ensure the slackless condition of the drawbar system 10 as well as performing the above-described function of preventing over-compression of the elastomeric pad 18 . According to the invention, the wedge 20 is also adjustable for placement in different fixed positions via a threaded shaft 52 that extends through a hole in the yoke, with a nut 54 being rotatable on the threaded shaft 52 in order to move the wedge vertically. The primary functions of the threaded shaft 52 and nut 54 are: To provide a pre-load to the elastomeric pad 18, and to adjust the load supplied by the wedge 20 as wear and tear over time develop. Adjustment of the wedge 20 is relatively simple, does not require disassembly of the yoke and other parts of the drawbar system, and is achieved in a relatively short period of service time. While only one threaded shaft 52 and associated nut 54 have been shown, it is also possible to provide two such threaded shafts and nuts, the pair of threaded shafts being spaced apart in the lateral, horizontal direction when viewing FIG. 5, with the two shafts being parallel and substantially in alignment with each other.

The yoke-assembly is completed with a rear wedge member 60 that acts as a channel or guide for the motion of the rear wedge that transfers the load to the yoke. While the rear wedge element 60 is shown as stationary, it is also within the scope and purview of the present invention to make it also vertically adjustable like the adjustable front wedge element 20, with the rear wedge element 60 also being provided with one or two threaded shafts like shafts 52, and a pair of associated nuts therefor. In this embodiment, the yoke-support frame portion 64 is extended in the forward, longitudinal direction to overlap the front wedge 20, as viewing FIG. 3, with appropriately placed holes being made therein, through which may pass the one or the pair of threaded shafts for the rear wedge element 60. As can be seen in FIG. 3, this yoke-support portion 64 is U-shaped in cross-section, and has a welded-on support plate 66 that provides the necessary strengthening of the yoke.

FIGS. 12–15 show the above-described drawbar system retrofitted with an intermediate F-type knuckle coupler 82 on the distal end of each drawbar shank, which thereby provides the advantages associated with coupler systems and drawbar systems.

While a specific embodiment of the invention has been shown and described, it is to be understood that numerous changes and modifications may be made therein without departing from the scope, spirit and intent of the invention as set forth in the appended claims.

What I claim is:

1. In a slackless drawbar system for a railway car having a car sill with striker, said slackless drawbar system comprising a drawbar shank, a but at one end of said shank comprising a rear surface having a convex shape, a follower member having a front concave surface end for mating engagement with said butt and a rear end, a wedge member operatively associated with said follower, a yoke defining a partially-open interior housing having a rear interior end surface and mounting therein said follower and said wedge element and a vertical pivot pin mounted at the forward end of said yoke and received through a vertical opening formed in said shank by which articulation between the shank and yoke is allowed, the improvement comprising:

said rear end of said follower means comprising a partially-open pocket and a rear surface stop;

said wedge member being positioned rearwardly of said follower and comprising a front end defining a partially-open pocket and a front surface stop;

an elastomeric pad element for absorbing buffing forces and angling forces and for providing a slackless condition, said pad element being housed in said yoke and having a front half and a rear half, said front half being positioned in said partially-open pocket of said follower, and said rear half being positioned in said partially-open pocket of said wedge member;

said wedge member and said follower being normally spaced apart from each other, with said stops thereof abutting each other during excessive buffing loads, whereby said elastomeric pad element is thereby protected from damage;

said wedge member comprising a rear wedge and a front, vertically-adjustable wedge, said front, vertically-adjustable wedge having a wedge face constituting said front end of said wedge member and a bottom surface, and means for adjusting the vertical position of said wedge for applying a preload to said elastomeric pad, and for loading said pad element after wear and tear thereof; said means for adjusting passing through said yoke and being accessible from the exterior of said yoke, whereby easy and safe vertical adjustment of the wedge is achieved, said partially-open pocket and said front surface stop of said wedge member being formed in said front, vertically-adjustable wedge;

said rear wedge abutting against said front, vertically-adjustable wedge for transferring buffing forces to said yoke, said rear wedge also abutting directly against said rear interior end surface of said interior housing;

said yoke comprising a forward flange having a front stop surface for cooperating with a stop surface of said striker of said car sill during pulling conditions.

2. The slackless drawbar system for a railway car according to claim 1, wherein said means for adjusting comprises a screw extending downwardly from said bottom surface of said wedge and a nut for said screw; said yoke comprising a lower reinforced portion having an opening through which passes said screw, whereby by applying torque to said nut from exterior of said yoke, said wedge is caused to move in one direction or the other.

3. The slackless drawbar system for a railway car according to claim 1, wherein said front surface of said follower comprises a pair of laterallypositioned, receding surfaces, said receding surfaces lying on opposite side of said concave surface of said front surface of said follower; said butt comprising a pair of substantially flat surfaces for abutting against said pair of receding surfaces, said flat surfaces lying on opposite sides of said convex-shaped rear surface, whereby during excessive angling, one or the other of said flat surfaces abuts against a respective said receding surface for compressing said pad to take up angling forces.

4. In a railway car having a center sill and striker, and a slackless drawbar system, said slackless drawbar system comprising a drawbar shank, a butt at one end of said shank comprising a rear surface having a convex shape, a follower member having a front concave surface end for mating engagement with said butt and a rear end, a wedge member operatively associated with said follower, a yoke defining a partially-open interior housing having a rear interior end surface and mounting therein said follower and said wedge element, and a vertical pivot pin mounted at the forward end of said yoke and received through a vertical opening formed in said shank by which articulation between the shank and yoke is allowed, the improvement comprising:

said rear end of said follower member comprising a partially-open pocket and a rear surface stop;

said wedge member being positioned rearwardly of said follower and comprising a front end defining a partially-open pocket and a front surface stop;

an elastomeric pad element for absorbing buffing forces and angling forces and for providing a slackless condition, said pad element being housed in said yoke and having a front half and a rear half, said front half being positioned in said partially-open pocket of said follower, and said rear half being positioned in said partially-open pocket of said wedge member;

said wedge member and said follower being normally spaced apart from each other, with said stops thereof abutting each other during excessive buffing loads, whereby said elastomeric pad element is thereby protected from damage;

said wedge member comprising a vertically-adjustable wedge having a wedge face and a bottom surface, and means for adjusting the vertical position of said wedge for applying a preload to said elastomeric pad, and for loading said pad element after wear and tear thereof; said means for adjusting passing through said yoke and being accessible from the exterior of said yoke, whereby easy and safe vertical adjustment of the wedge is achieved;

said wedge member further comprising a rear, stationary wedge that abuts against said vertically-adjustable wedge for transferring buffing forces to said yoke, said rear wedge also abutting directly against said rear interior end surface of said housing;

said yoke comprising a forward flange having a front stop surface for cooperating with a stop surface of said striker of said car sill during pulling conditions.

5. The railway car according to claim 4, wherein said means for adjusting comprises a screw extending downwardly from said bottom surface of said wedge and a nut for said screw; said yoke comprising a lower reinforced portion having an opening through which passes said screw, whereby by applying torque to said nut from exterior of said yoke, said wedge is caused to move on one direction or the other.

6. The railway car according to claim 4, wherein said front surface of said follower comprises a pair of laterally-positioned, receding surfaces, said receding surfaces lying on opposite side of said concave surface of said front surface of said follower; said butt comprising a pair of substantially flat surfaces for abutting against said pair of receding surfaces, said flat surfaces lying on opposite sides of said convex-shaped rear surface, whereby during excessive angling, one or the other of said flat surfaces abuts against a respective said receding surface for compressing said pad to take up angling forces.

* * * * *